US010835904B2

(12) United States Patent
Cilia

(10) Patent No.: US 10,835,904 B2
(45) Date of Patent: Nov. 17, 2020

(54) METHOD OF PLANT RESIN SEPARATION AND EXTRACTION

(71) Applicant: Tetragrow LLC, Calistoga, CA (US)

(72) Inventor: David M Cilia, Calistoga, CA (US)

(73) Assignee: Flavorscope LLC, Calistoga, CA (US)

( * ) Notice: Subject to any disclaimer, the term of this patent is extended or adjusted under 35 U.S.C. 154(b) by 0 days.

(21) Appl. No.: 16/423,066

(22) Filed: May 27, 2019

(65) Prior Publication Data

US 2019/0283038 A1 Sep. 19, 2019

Related U.S. Application Data

(63) Continuation-in-part of application No. 15/640,111, filed on Jun. 30, 2017, now Pat. No. 10,300,494, which is a continuation-in-part of application No. 14/634,794, filed on Feb. 28, 2015, now Pat. No. 9,718,065.

(60) Provisional application No. 61/946,536, filed on Feb. 28, 2014.

(51) Int. Cl.
*B03B 7/00* (2006.01)
*B03B 5/28* (2006.01)

(52) U.S. Cl.
CPC . *B03B 7/00* (2013.01); *B03B 5/28* (2013.01)

(58) Field of Classification Search
CPC ..... B03B 7/00; B03B 5/28
USPC ..... 209/12.1, 13, 17, 18, 162
See application file for complete search history.

(56) References Cited

U.S. PATENT DOCUMENTS 2,922,521 A 1/1960 Schranz
4,051,771 A 10/1977 Miyata et al.
4,795,651 A * 1/1989 Henderson ..... B03B 5/28 426/456
4,964,576 A * 10/1990 Datta ..... B02C 17/16 209/168
6,158,591 A * 12/2000 Delp ..... B01D 11/0257 209/17
6,988,622 B1 * 1/2006 Victor ..... A23N 4/24 209/156
8,640,877 B1 2/2014 Pastorius
8,955,687 B1 * 2/2015 Dews ..... B07B 1/02 209/235
9,066,910 B2 * 6/2015 Rosenblatt ..... A61P 25/00
(Continued)

FOREIGN PATENT DOCUMENTS

WO 200400919 A2 1/2014

OTHER PUBLICATIONS

"Home-made hash", by Wombat, dated Mar. 8, 2005, downloaded from <http://www.poUv/video/2005/03/08/4117/>.

(Continued)

*Primary Examiner* — Terrell H Matthews
(74) *Attorney, Agent, or Firm* — Edward S. Sherman

(57) ABSTRACT

A process for trichome separation from plant matter deploys an ionic brine to induce oedemic transformation of disk cell to aid in releasing glandular trichomes. The brine can be agitated to further release disk cells from the plant tissue. The disk cell debris can be separated by sieving the larger trichomes and plant tissue particles that results from agitation and maceration. If the brine concentration is appropriately modified, the trichomes will float and the brine and the plant tissue fragments sink. The floating trichomes are then removed and rinsed and then dried or extracted further after drying.

19 Claims, 9 Drawing Sheets

(56) References Cited

U.S. PATENT DOCUMENTS

| | | | |
|---|---|---|---|
| 2009/0250383 | A1 | 10/2009 | Young et al. |
| 2016/0160439 | A1 | 6/2016 | Mohhamadi et al. |

OTHER PUBLICATIONS

"Inside the Trichome", by Bubbleman and Jeremiah Vandermeer, published on Cannabis Culture on Jun. 12, 2009.

* cited by examiner

METHOD OF PLANT RESIN SEPARATION AND EXTRACTION

CROSS REFERENCE TO RELATED APPLICATIONS

The present application is a Continuation-in-part of and claims the benefit of priority to the US Non-Provisional patent application of the same title having application Ser. No. 15/640,111 that was filed on 30 Jun. 2017, which in turn is a Continuation-in-part of and claims the benefit of priority to the US Non-Provisional patent application of the same title having application Ser. No. 14/634,794 that was filed on 28 Feb. 2015, and issued as U.S. Pat. No. 9,718,065 on 21 Aug. 2017, all of which are incorporated herein by reference.

The present application also claims the benefit of priority to the US Provisional patent application of the same title having application Ser. No. 61/946,536 that was filed on Feb. 28, 2014, all of which are incorporated herein by reference.

BACKGROUND OF INVENTION

The field of the present invention is the extraction of resins containing organic compounds from resinous plants, and more particularly to the separation of resin from resin-bearing glandular trichomes being from none or low resin bearing plant matter.

A number of plant varieties produce commercially valuable isoprene derivatives and phenolic compounds such as terpenes, alpha acids, beta acids, flavonoids and terpenoids in cell assemblies know as trichomes or more specifically, in the glands of glandular trichomes. Portions of different plants are rich in trichomes containing compounds of interest in commercial and medicinal applications. Conventional extractive processes may not be adequate in preserving volatile and/or oxidation-sensitive compounds.

Conventional extraction and separation methods utilize solvents which may be polar, non-polar or combinations thereof in order to extract and separate desirable substances. Conventional extraction methods are expensive to conduct safely and may introduce undesired compounds by collateral extraction. Commonly extracted undesirable compounds may include pigments such as anthocyanin, chlorophyll, tannins, saponins and lipids from cellulosic and other plant materials.

Further, as plants mature, many glands of glandular trichomes increase in size, mass and chemical composition. Plant cells associated with the trichomes biosynthesize phenolic compounds including terpenoids such as cannabinoids and humulones. However, at harvest time, when the plant is deemed to have reached a peak in the content of desired compounds, trichome assemblies may be in a range of sizes. It is believed that larger trichomes may have a different composition than the smaller trichomes. Hence, it would also be desirable to separate trichomes by size before chemical extraction or separation of such mixture of compounds from the trichomes.

Trichome and trichome gland assemblies can be separated from the bulk of undesirable plant material by sieving procedures. Larger trichomes can be harder to separate from undesirable plant matter that do not contain desired chemical species While relatively small trichome glands can be separated from undesirable plant materials by sieving procedures, larger trichomes can be harder to separate, as larger sized sieve fractions contain greater amounts of undesirable plant material thereby diluting the net content of desirable compounds in trichomes and trichome glands. Physical dilution necessitates significant fragmentation of the less desired plant matter. However, as resin bearing trichomes are sticky, physical separation by dry or wet sieving processes are problematic because a large fraction of plant matter fragments of comparable size to the desired trichomes are generated from the mechanical force of agitation, chopping or grinding of the plant matter to release the desirable trichomes and/or trichome glands.

Accordingly, it is an object of the present invention to provide an improved process for separating desirable trichomes and/or specific trichome structures from undesirable trichome parts and/or plant matter that overcomes the aforementioned disadvantages. Such undesirable trichome parts include trichome stems that do not contain desired compounds, or non-resin bearing trichomes.

The above and other objects, effects, features, and advantages of the present invention will become more apparent from the following description of the embodiments thereof taken in conjunction with the accompanying drawings

SUMMARY OF INVENTION

In the present invention, the first object is achieved by providing a method of trichome separation from plants, the method comprising the steps of providing a trichome bearing plant material, the trichomes being attached to at least some of the plant material by disk cells, and the disk cells being attached to at least some plant tissue in the plant material, introducing the trichome bearing plant material in a brine of sufficient concentration to swell the disk cells to release at least some of the trichomes to provide free trichomes, at least one of agitating and macerating the trichome bearing plant material to induce the separation of disk cells within disk cell assemblies, trichomes from disk cells and disk cell assemblies and the disk cells and disk cell assemblies from plant tissues, diluting the brine to reduce the density such that at least the free trichomes float and other plant matter sinks, removing the floating trichomes, rinsing the removed trichomes to remove a residue of the brine, and drying the rinsed trichomes.

A second aspect of the invention is characterized by a method of trichome separation from plants wherein the brine comprises one or more salts selected from the group consisting of sodium chloride, magnesium chloride and magnesium sulphate.

Another aspect of the invention is characterized by any such method of trichome separation from plants, the method further comprising a step of filtering disk cell fragments smaller than the trichomes before said step of diluting the brine.

Another aspect of the invention is characterized by any such method of trichome separation from plants wherein said step of agitating is by one or more of shaking, stirring, stirring with at least one of immersed blades and re-circulating water jets, and agitation with ultrasound.

Another aspect of the invention is characterized by any such method of trichome separation from plants wherein the plant is a from a genera selected from the group consisting of *Populus, Nicotiana, Cannabis, Pharbitis, Apteria, Psychotria, Mercurialis, Chrysanthemum, Polypodium, Pelargonium, Mimulus, Matricaria, Monarda, Solanum, Achillea, Valeriana, Ocimum, Medicago, Aesculus, Plumbago, Pityrogramma, Phacelia, Avicennia, Tamarix, Frankenia, Limonium, Foeniculum, Thymus, Salvia, Kadsura, Beyeria,*

*Humulus, Mentha, Artemisia, Nepta, Geraea, Geraniaceae, Pogostemon, Majorana, Cleome, Cnicus, Parthenium, Ricinocarpos, Hymennaea, Larrea, Primula, Phacelia, Dryopteris, Plectranthus, Cypripedium, Petunia, Datura, Mucuna, Ricinus, Hypericum, Myoporum, Acacia, Diplopeltis, Dodonaea, Halgania, Cyanostegia, Prostanthera, Anthocercis, Olearia, Viscaria.*

Another aspect of the invention is characterized by any such method of trichome separation from plants wherein the plant is from a genera selected from the group consisting Cannabaceae and Lamiaceae family.

Another aspect of the invention is characterized a method of trichome separation from plants, the method comprising the steps of providing a trichome bearing plant material, the trichomes being attached to at least some of the plant material by disk cells, and the disk cells being attached to at least some plant tissue in the plant material, introducing the trichome bearing plant materials in a brine of sufficient concentration to swell the disk cells to release at least some of trichomes, the brine having a first specific gravity, at least one of agitating and macerating the trichome bearing plant material to induce the separation of disk cells within disk cell assemblies, trichomes from disk cells and disk cell assemblies and the disk cells and disk cell assemblies from plant tissues, separating one or more predetermined size fractions of the agitated trichome bearing plant material, rinsing the one or more predetermined size fractions agitated trichome bearing plant material on a screen to retain the trichomes and remove smaller disk cells and fragment of disk cells than openings in the screen, floating the rinsed one or more predetermined size fractions of trichomes bearing plant material on a fluid having a second specific gravity, removing the trichomes that float on the fluid having a second specific gravity after other plant matter sinks in the fluid, rinsing the removed trichomes.

Another aspect of the invention is characterized by such a method of trichome separation from plants further comprising a step of drying the rinsed trichomes.

Another aspect of the invention is characterized by any such method of trichome separation from plants further comprising a step of extracting the dried trichomes.

Another aspect of the invention is characterized by any such method of trichome separation from plants further comprising a step of combining two or more predetermined size fractions of trichomes and plant matter that were rinsed and wherein said step of floating the rinsed one or more predetermined size fractions of trichomes and plant matter having a second specific gravity comprises floating the combined two or more predetermined size fractions of trichomes and plant matter.

Another aspect of the invention is characterized by any such method of trichome separation from plants wherein the brine has a density of at least 1.2 gm/cc and the fluid having substantially the same composition of the brine and has a second specific gravity of less than 1.19 gm/cc.

Another aspect of the invention is characterized by any such method of trichome separation from plants wherein the brine has a density of at least 1.2 gm/cc and the fluid having substantially the same composition of the brine and has a second specific gravity of less than 1.19 gm/cc.

Another aspect of the invention is characterized by any such method of trichome separation from plants wherein said step of floating the rinsed one or more predetermined size fractions of trichomes and plant matter in a fluid of second specific gravity comprises floating different size fraction is different second fluids, each of the different second fluids having a different specific gravity than the other.

Another aspect of the invention is characterized by a method of trichome separation from plants, the method comprising the steps of providing a trichome bearing plant material, the trichomes being attached to at least some of the plant material by disk cells, and the disk cells being attached to at least some plant tissue in the plant material, at least one of agitating and macerating the plant material to induce the separation of trichomes and disk cells from plant tissues to form plant matter, introducing the plant matter in a brine of sufficient concentration to swell the disk cells to release at least some of trichomes from the disk cells, removing the disk cells and disk cell fragments from the brine, removing at least trichomes from the brine.

Another aspect of the invention is characterized by such a method of trichome separation from plants wherein said step of removing disk cells and disk cell fragments from the brine comprises rinsing at least one predetermined size fraction of plant matter on a screen to retain the trichomes and remove smaller disk cells and fragments of disk cells through the openings in the screen, Another aspect of the invention is characterized by any such method of trichome separation from plants wherein said step of removing trichomes from the brine further comprises a step of placing the trichomes and any residual plant matter retained on the screen in a fluid in which the trichomes float and the plant tissue in the plant matter sinks and then removing the floating trichomes from the fluid.

Another aspect of the invention is characterized by any such method of trichome separation from plants wherein the fluid has a lower specific gravity than the brine.

Another aspect of the invention is characterized by any such method of trichome separation from plants wherein the fluid is obtained by diluting the brine.

Another aspect of the invention is characterized by any such method of trichome separation from plants wherein the brine comprises one or more salts selected from the group consisting of sodium chloride, magnesium chloride and magnesium sulphate.

The above and other objects, effects, features, and advantages of the present invention will become more apparent from the following description of the embodiments thereof taken in conjunction with the accompanying drawings.

DETAILED DESCRIPTION

Figure 1:
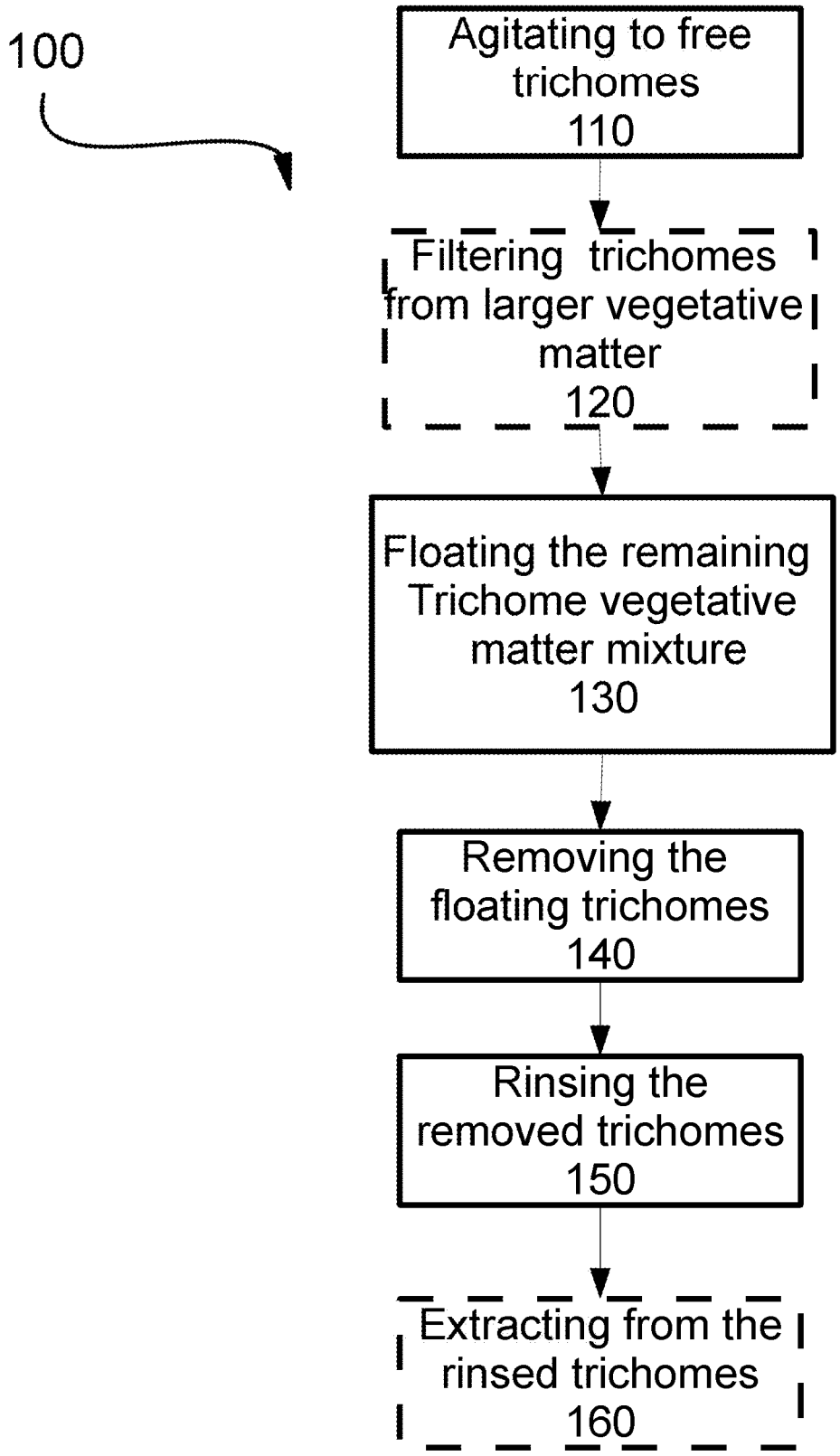
FIG. 1 is a schematic process flow chart.

Referring to FIGS. 1-9, wherein like reference numerals refer to like components in the various views, there is illustrated therein a new and improved Method of Plant Resin Separation and Extraction, generally denominated 100 herein.

In accordance with the present invention, processes 100 of FIGS. 1,3 and 6-9 comprise a series of steps for separating resin rich glandular trichomes from vegetative matter. Terpenoids including cannabinoids and other compounds secreted within glandular trichomes have significant commercial applications. Glandular trichomes occur most abundantly on the floral calyxes and associated leaves on the inflorescences of female *Cannabis* plants. The secreted compounds frequently remain in and swell the trichome glands, which are cell clusters, giving them a resinous character.

The particular, sieve sizes, methods of agitation, sieve fractions deployed in one or more separation processes in step 110-130 will depend on the nature of the target glandular trichomes produced by the plant. In one embodiment, in step 110, the physical agitation of the plant matter with the desired trichomes is employed so that terpenoid or cannabinoid-rich trichomes and trichome glands break free of the floral calyxes, bracts as well as the leaves they may form on or stick to. Physical agitation of plant matter (110) is preferably done in an ice and water slurry as cold temperatures help increase the efficacy of mechanical forces in breaking free trichomes and resin-containing trichome glands from bulk plant material. Prior to step 110, plant matter may or may not be chopped up or ground in order to help release trichomes and trichome glands from plant matter during step 110.

A preferred method of agitation in step 110 is wet agitation by enclosing the trichome bearing plant matter in a wide mesh sieve bag, which in the case of cannabis is preferably 220 micron. The bag is then agitated in an ice and water bath slurry. As the plant matter is agitated, trichomes of various sizes are released into the ice and water slurry through the holes in the mesh bag or equivalent containment vessel. The trichomes are ultimately removed from the bulk of the plant matter when the water is drained as the bulk vegetative matter is retained in the bag. A commercial washing machine can be used for this purpose with the drain hose line used to collect the trichome and other plant matter that exits the holes in the mesh bag.

Alternatively, the inventive process will also work on dry-sieved material. Such dry sieving of material is preferably performed at cold temperature, as for example like hops which are typically dry sieved at −30 C.

However, wet sieving offers advantages over dry sieving as a considerable amount of undesirable water soluble components will be removed when the water is drained from the final filter fraction(s).

Cold temperatures will have a dramatic effect in either wet or dry method on making the desirable oil glands less sticky and harder. This means that the result is usually higher desirable oil content, with less potential loss of more volatile components. Further, it is also possible to further process dry sieved materials, such as with ice slurry extractions to break oily trichome glands, or the resin bearing portion thereof, away from extraneous matter and remove polar components from plant material (most notably pigments, chlorophyll).

Alternatively, depending on the plant species and the method of separation in the vessel 135, it may be possible to simply place the trichome containing plant matter directly in the brine or fluid and perform the agitation, chopping or grinding in the same vessel 135 as used for separation. Such a method can deploy in the simplest state a hand held kitchen immersion mixer/blender, or the industrial equivalent thereof, as well as aggressive shaking, stirring, re-circulating water jets, and agitation with ultrasound.

In addition to trichomes and trichome glands of various sizes, significant amounts of undesirable plant matter are released with a mixture of desirable trichomes as this undesirable plant material is frequently of comparable size. Further sieving (optional step 120), can be used to provide one or more cuts or fractions of trichomes and plant matter of different pre-determined size ranges between a lower bound represented by the opening in the next smallest filter, and an upper bound by the previous filter opening size, which is optionally the original mesh bag used in the agitated water bath in step 110.

One such separation method is disclosed in issued U.S. Pat. No. 8,640,877 (Pastorius, Feb. 4, 2014) for a pollen separator, which is incorporated herein by reference. Various raw plant materials are processed via such water and ice agitation method. It further suggests that small diameter mixtures of plant pollen and plant debris are separated by eight sieves, having progressively smaller holes from 220, 190, 160, 120, 90, 73, 45 to 25 microns. However, the patent is silent on separating the desired pollen or other components from plant debris of the same size, other than by solvent extraction. Similarly, U.S. Pat. No. 4,051,771 (Miyata, et al., Oct. 4, 1977), which is also incorporated herein by reference, discloses an apparatus for obtaining lupulin-rich products from hops, in which lupulin glands or trichomes are extracted by a combination of crushing and dry sieving in a frozen state.

Trichomes and trichome glands vary in size as plants mature. It is believed that trichomes of different sizes will have correspondingly different chemical compositions.

In the case of medicinal cannabis preparation, the trichomes in the 74 to 119 micron diameter range are generally considered to be the most desirable for potency, as the dry weight percentage of desirable substances in this size fraction range is significantly higher than in larger fractions (circa greater than 119 microns). This is likely to be the results of larger particle size fractions, which is with trichomes of 119 microns or greater being diluted by a disproportionate excess of plant matter that is not otherwise separable by mechanical sieve fractionation. In other words, fractions containing trichomes greater in size than about 119 microns would contain a larger proportion of plant matter, resulting in a dry weight lower concentration of the desired medicinal compounds available almost exclusively in the trichome glands.

As it would be desirable to fractionate trichomes based on size, depending on the chemical composition(s) of interest, there is a need for a separation process that does not chemically extract undesirable plant matter and/or chemically modify or oxidize the target terpenoids or terpene derivatives in the separation process. By terpene derivative, I mean terpene compounds and metabolic compounds formed by further synthesis within the glands. Such terpene derivatives include cannabinoids, terpenoids and related resinous compounds.

It has been discovered that sieve filter fractions that contain a higher percentage of undesirable plant matter in relation to desirable trichomes of the same size, can be processed without polar or non-polar solvents that would co-extract undesired chemical compounds from both the undesirable trichome parts (e.g. stalks and disc-cells) and the plant matter of the same size.

Figure 2A:
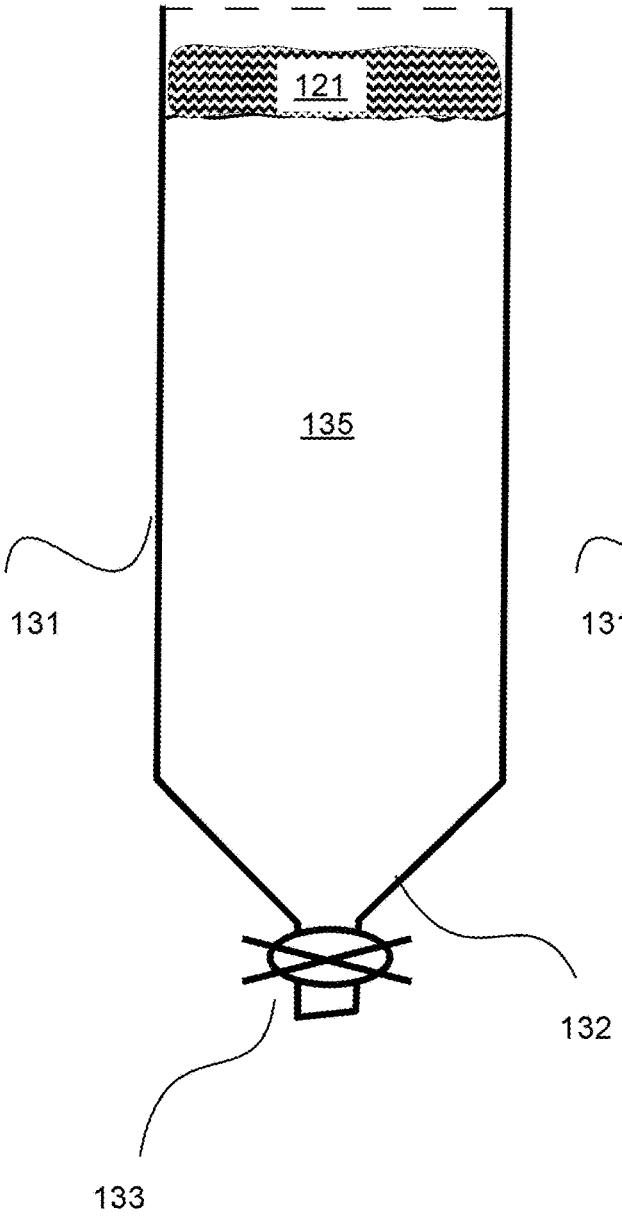
FIGS. 2A and 2B are schematic diagram of the fluid separation step in FIG. 1.
Figure 2B:
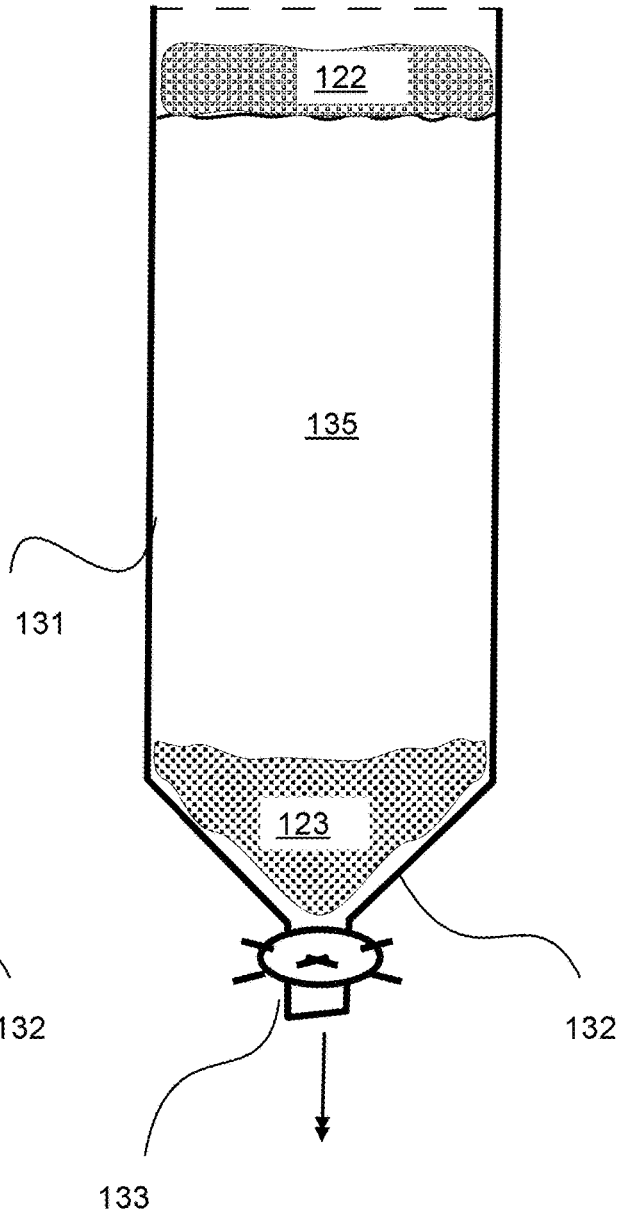

Then, in step 130, one of more fractions containing trichomes of a desired size can be further treated to remove unwanted plant matter of the same size. The excess water, that is free draining water or water easily removed by modest pressure, from the sieve fraction is preferably removed, and the remaining solids are disposed on the surface of a tank or vessel 131 containing an inert fluid 135 with a specific gravity greater than that of the net specific gravity of the target trichomes, which is generally but not exclusively greater than about 1.1 gm/cc or greater. The fluid density is more preferably 1.3 or greater As shown in FIG. 2A, after sufficient agitation to wet or introduce all of the mass 121 to the fluid 135, the heavier typically more cellulosic fractions including vegetative matter, disk cells, broken and visibly oxidized trichome glands and non-gland portions of trichomes (stalks) sink 123, separating at the bottom portion 132 of vessel 131. The lighter fraction 122, containing resin filled trichomes float on fluid 135 (FIG. 2B).

Accordingly, a preferred embodiment of the invention disclosed herein is the separation of cannabis trichomes from cannabis vegetative matter in the size range of 160 microns and greater, and more preferably 90 microns and greater. However, the inventive method will remove undesirable plant components from small size fractions as well. It should be noted that below 160 microns, the main contaminant in cannabis is actually the trichome stalks and other non-glandular trichome parts. Unexpectedly, I also observed visibly broken and oxidized glands only in the sinking fraction 123 as described below with respect to step 130, while the floating fraction 122 contained only full, bulbous clear trichome heads.

Depending on the plant variety and the ease of trichome release without fragmentation, it may be desirable to avoid chopping, grinding and fragmentation until the weakly bound trichomes are released by minimum physical agitation, such as by shaking and agitating without chopping or grinding. For example, the initial shaking may deploy a sieve with 220 micron holes.

Further, prior to step 130, post-sieved material may undergo further physical separation by agitation in fluid slurry may contain solid matter such as ice, ceramic beads, and the like, as well as chemical agents, such as wetting agents, dispersion agents, ionic and/or non-ionic surfactants, saponification (soaping) agents, anti-foaming agents and the like.

The separating medium 135 is a dense inert fluid that is easily removed from the desired lower density trichomes, and also preferably has a low solubility of oxygen, or oxygen is readily removed by sparging with inert gases such as carbon dioxide, nitrogen and argon to prevent oxidation.

The inert fluid is more preferably a brine that can be formed by the super saturation of water with a soluble salt, such as sodium chloride, magnesium chloride or magnesium sulphate, and the like. For example, hot water can dissolve about 350 gm/L of common salt (sodium chloride), of which upon cooling some will precipitate, leaving dense salt saturated brine with a specific gravity greater than about 1.18 gm/cc. The separating fluid 135 may include ionic and non-ionic surfactants or any other such agent that facilitates the dispersion of desired glandular trichomes in the floating fraction 122 from undesirable components that form the sinking fraction 123.

It is also preferable to deploy moderate agitation to optimize dispersion of the plant matter-trichome mixture 121 as to facilitate the physical separation of the plant matter 123 which sink and the trichome-rich layer 122 which float. Agitation may be achieved by one of or any combination of reciprocal plunging, shaking, stirring, re-circulating water jets. Agitation may also be achieved via acoustic energy via submerged ultrasonic probes or loudspeaker outside of the vessel. Sound vibrations of a particle frequency range may be operative provide controlled and measurable mechanical separation energy into the fluid trichome/brine solution. This energy will be used to help further disperse all particles so that they may separate based on density while minimizing flocculation, clumping, Van der Wals forces, etc. Agitation can also be achieved by jets of compressed gas, such as air or more preferably nitrogen or inert gas.

It is preferred to use cold brine as fluid 135, and more preferably dry ice chilled brine so the resin filled trichomes and the more volatile isoprene or terpenoid compounds are precluded from evaporation and oxidation in the carbon dioxide ($CO_2$) saturated environment.

The lower portion of vessel 131 is preferably shaped as an inverted cone, so that the vegetative fraction 123 can be drained as shown by the arrow in FIG. 2B, by opening the valve 133. Alternatively, or in addition to, the trichomes floating on the top of the fluid 135 in the vessel 131 can be removed (step 140) from the vessel by a fine screen or mesh into the fluid to lift them from underneath, and/or draining the plant matter from the bottom of the vessel either before or after using the screen.

Maintaining cold temperatures in fluid 135 will have a dramatic effect on reducing the cohesive nature of the often sticky desirable oil-containing glands from less desirable material in mixture 121. By reducing cohesion in mixture 121, the efficiency of the separation of trichome rich floating 122 from the undesirable sinking fraction 123 is facilitated. An optimized dispersion of mixture 121 is believed to yield a floating fraction 122 having a higher desirable oil content. Maintaining cold temperatures may also reduce the chemical degradation as well as evaporative loss of certain and/or more volatile desirable components. Further, it is also possible to further process mixture 121 obtained from dry sieving, such as with ice slurry extractions to break oily trichome glands, or the resin bearing portion thereof, away from extraneous matter and remove polar components from plant material (most notably pigments, chlorophyll) otherwise removed in 100.

After physical separation of the floating desired trichomes, the trichomes may be further washed to remove the salt from the brine (step 140), after which the resulting product is then rinsed preferably with water, particularly when the liquid 135 is a salt brine or another non-solvent, to remove this liquid 135 (step 150).

Depending on the amount of undesirable plant material in any sieve fraction, or bulk mass or material introduced to the fluid 135 in vessel 130, it is preferable to repeat the floating in step 130 multiple times after draining off the sinking vegetative fraction 123 via valve 133.

During such repetitive floating in step 130, as the brine or fluid 135 is replaced, the specific gravity thereof may be adjusted in order to optimize the separation of the desired glandular trichome components from the undesirable components from different sieve fractions or the previous draining step. It is believed that desirable and undesirable components from each of the sieve fractions may have correspondingly unique components with unique properties. Such modification to the fluid in step 130 may include one or more of adjustments, to the composition, i.e. type of salt, concentration of salt to vary the specific gravity, as well as the temperature, which will also affect the specific gravity.

The trichomes can be further processed (optional step 160) to remove or extract the desired chemical compounds from the cell walls and nuclei, with any known or subsequently discovered solvent and/or process methods. Alternatively, the lighter fraction 122 (containing resin filled trichomes float on fluid 135) may be treated with a flocculating agent to aid in recovery of the trichomes. The inventive process may be useful for the purpose of separating non-oil containing products (e.g. the trichome stalk), which are expected to float in the vessel 130 between the floating lighter fraction 122 and sinking fractions 123. These components may prove to have additional uses such as a replacement for DE (diatomaceous earth).

In particular, the invention is applicable to all plants from families with glandular trichomes, for example Asteraceae (sunflower, etc.), Solanaceae (tomato, tobacco, potato, pepper, eggplant, etc.), Cannabaceae (*Cannabis sativa, Humulus, H. Lupulus*) and Lamiaceae (mint, basil, lavender, thyme, etc.). In a non-limiting manner, the invention can apply to trichomes of plants from the following genera: *Populus, Nicotiana, Cannabis, Pharbitis, Apteria, Psychotria, Mercurialis, Chrysanthemum, Polypodium, Pelargonium, Mimulus, Matricaria, Monarda, Solanum, Achillea, Valeriana, Ocimum, Medicago, Aesculus, Plumbago, Pityrogramma, Phacelia, Avicennia, Tamarix, Frankenia, Limonium, Foeniculum, Thymus, Salvia, Kadsura, Beyeria, Humulus, Mentha, Artemisia, Nepta, Geraea, Geraniaceae, Pogostemon, Majorana, Cleome, Cnicus, Parthenium, Ricinocarpos, Hymennaea, Larrea, Primula, Phacelia, Dryopteris, Plectranthus, Cypripedium, Petunia, Datura, Mucuna, Ricinus, Hypericum, Myoporum, Acacia, Diplopeltis, Dodonaea, Halgania, Cyanostegia, Prostanthera, Anthocercis, Olearia, Viscaria.*

Preferably, the plant is a plant from the Cannabaceae or Lamiaceae family. In a more preferred embodiment, the plant belongs to the genera *Humulus* or *Cannabis*, both members of the Cannabaceae family. The hop plant, *Humulus lupulus*, produces glandular trichomes containing humulone and lupulone which are important in beer brewing both from organoleptic and microbial-stability impact. *Cannabis* produces pharmaco-active and non-pharmaco active compounds. Compounds biosynthesized in the glandular trichomes of hops have anti-bacterial properties and recently have been investigated in the development of drugs used to treat diabetes. Compounds biosynthesized in the glandular trichomes of *Cannabis* may have anti-epileptic, anti-emetic, anti-inflammatory, neuroprotective and even anti-cancer properties.

The inventive process is also applicable to trichomes from one genetically distinct organism being grown on another, a genetically modified organism, (GMO). An example of this would be transgenic algae (or fungi such as *Aspergillus*) engineered to produce oil trichomes and associated oils from *Cannabis*. Hence, the invention is also applicable to extracting cannabinoids, terpenoids, and related terpene derivative compounds from plants, fungi or algae of any species, including transgenic organisms that express one or more nucleic acid encoding a protein associated with the metabolic pathway to synthesize such compounds.

This process could be employed in a manner similar to the production of ascorbic acid (vitamin c) in a continuous-flow or batch production schematic. In this case, the fungus *Aspergillus niger* is genetically engineered to produce vitamin C.

It should also be appreciated that trichomes, glandular or otherwise, are frequently involved in allelopathy. This invention may allow for the production of new botanically sourced pesticide compounds, previously cost-prohibitive, to research and/or produce. One such example is the separation of nicotine containing trichome from tobacco leaves, which is used as a very potent insecticide, as well as insecticidal agents in trichomes on tomato leaves and stalks.

Density based isolation of the trichome cells has been limited to laboratory scale extraction for research purposes that are unsuitable for commercial production. Such density extraction methods use the Percoll™ reagent to form density gradients in test tubes when subjected to very high centrifugal forces from a centrifuge apparatus. This technique creates a gradient with the Percoll reagent, within which fine layered bands of different density materials will separate.

Such methods are not suitable for production purposes for several reasons. First, the Percoll suspension introduces contamination in the form of silica nanospheres and the repellant coating. This material cannot be removed after separation due to the nano size. Percoll reagent, in addition to being a contaminant is an expensive material. Hence, It is only suitable for research purposes in extracting small quantities of cell or organelles, usually by forming a density gradient by centrifuging. Though density gradients can be formed by layering methods, the introduction of any reasonable quantity of macerated plant matter will require mixing that will disturb such a gradient Prior art wet sieving extraction processes for Cannabaceae trichomes yield an inseparable mix of desirable trichomes and undesirable plant debris, based on size as well as the duration and intensity of agitation. Such a process is generally disclosed in the International Patent Application with publication no. WO 2014/00919A2 (to J. P. Love, which published (January 2014), and is incorporated herein by reference. Smaller size fractions of plant material tend to yield a greater amount of desirable trichomes and therefore a higher yield of desired substances. However, the greater the amount of agitation of plant material, the greater the concomitant release of both desirable and undesirable substances from plant material regardless of particle size restrictions.

Hence, such a prior art water extraction processes has 2 primary limitations. First the total yield of trichome resin is limited to the smaller trichomes. While the extraction of resins from other trichome bearing plant matter can be accomplished with solvents, these processes are less desirable as mentioned in the background section. As the total yield of desirable substances from this remaining plant matter will be low, they are even less economically attractive than using only solvent extraction.

The second limitation is the total concentration of cannabinoids resins. The state of the art water extraction processes result in up to about 60-70% THC and related resins, which is comparable to solvent extraction. State of the art water extractions yielding material with 60-70% by weight total cannabinoid resins, including THC. Such water extraction products utilize a significantly smaller portion of the total THC bearing trichomes as these extracts are limited, at best, to particle sizes of 90 to 45 microns. Although, occasionally some strains of cannabis yield material that qualifies as "ice wax" from the 120 micron fraction.

In a currently preferred embodiment, the total yield of cannabinoids resins, based on weight of starting plant matter, is higher than current water extraction methods by a factor of about 2× (usually 3 to 6% of the total plant matter), with the resulting product being purer, containing 70-75% by weight total cannabinoid resins.

It has been discovered that such higher yields and greater extraction efficiency can be achieved by a totally different approach. Rather than gentle agitation of plant matter to sever the more trichomes with respect to undesirable plant debris, a greater variety of plant material is aggressively macerated to release all size trichomes as well as an abundance of undesirable plant debris. While this produces undesirable plant debris of all sizes, including trichome head or resin sacks, it has been discovered that the gravity separation process, in a uniform density fluid, is best optimized for each size fraction, which is floated in a different vessel from the other size fractions. More preferably, each size fraction is separated in a different density fluid, which is preferably a brine or salt solution. Each fraction is obtained by draining the cold agitated slurry of plant matter and ice water through a 220 micron opening mesh bag into a vibratory screen stack with constant cold water flushing. The preferred screen sizes, indicated by the size range of the retained fractions, is provided in Table 1. Each sieve size fraction is then floated in a separate brine bath (FIG. 3), as the smaller fractions take longer for complete gravity separation, in that once the fraction is covered in the brine, the smaller desirable resin heads take longer to float free of the undesirable heavier matter. Alternatively, if the sieve fraction is washed into the top of a tank of brine, it takes longer for the undesirable matter to sink. It is also preferable that the brine salt is a magnesium sulfate brine, and most preferable that it contains about 10 wt % sodium chloride as a deflocculating agent in the density separation process after sieving. The use of sodium chloride alone is problematic in that it is difficult to rinse the residual salt, which negatively effects the taste and flavor profile of the product. In contrast, the preferred brine composition can be readily rinsed in a final step without leaving detectable residue. The use of 10% sodium chloride aids in deflocculating of agglomerated matter, so the denser undesirable matter separates from lighter matter and sinks.

As the undesirable stalks and desirable resin heads in the smaller size fractions segregate in the floating step significantly slower than in the larger size fractions, it is also desirable to use a greater density fluid or brine for these smaller fractions, as disclosed in Table 3. Further, by separately treating the more slowly segregating components of smaller sizes the tanks sizes and or tank number for the floating step can be adjusted to accommodate the different separation rates. In other words, tanks used for the heavier fractions will be cycled faster, so the larger or more numerous tanks for the smaller fractions can provide a comparable process throughput. Using a more dense brine for the smaller fractions with the most desired salt composition accelerates the gravity separation process.

The preferred brine compositions also enhances the separation of trichome fragments, namely the undesirable stalk and disk cells from the resin bearing sacks at the end of the disk cells. Unless the trichomes are extremely mature, the stalks due to their length, can be a significant fraction of the total trichome volume. Additional dilution of desirable substances results from the introduction of non-glandular trichomes known as cystolith hairs. Cystolith hairs are composed mainly of silicon dioxide ($SiO_2$) and frequently contain calcium carbonate ($CaCO_3$) crystals within.

The currently preferred concentrations of brine for each sieve fraction as listed in Table 1:

TABLE 1

| Sieve size (microns) (particles this size and larger) | Brine density (gm/cc) | Brine salt composition, (by wt %) | Control (gm from 1 Kg. plant matter, dried, without gravity separation) | Separated (gm), after gravity separation in indicated brine | Fraction recovery, % with respect to Control |
|---|---|---|---|---|---|
| 125-220 | 1.11 | 90/10% MgSO4/NaCl | 4.45 | 2.36 | 53% |
| 105-124 | 1.12 | 90/10% MgSO4/NaCl | 5.25 | 3.21 | 61% |
| 90-104 | 1.13 | 90/10% MgSO4/NaCl | 6.97 | 6.15 | 88% |
| 70-89 | 1.14 | 90/10% MgSO4/NaCl | 16.84 | 14.03 | 83% |
| 50-69 | 1.15 | 90/10% MgSO4/NaCl | 16.71 | 7.26 | 43% |
| 40-49 | 1.15 | 90/10% MgSO4/NaCl | 2.5 | 1.09 | 44% |
| Total recovery | | | 52.7 gm | 34.1 gm | 0.65% |

The results in Table 1 were obtaining starting with 1,000 gm of plant matter from the *Cannabis* plant O. G. Kush variety "Tahoe" (usually referred to as "Tahoe O. G".). Hence, the total yield of resin heads without other matter was 3.4%. Other varieties have yielded as high as 6% with about 74.5% total cannabinoids by weight.

Figure 3:
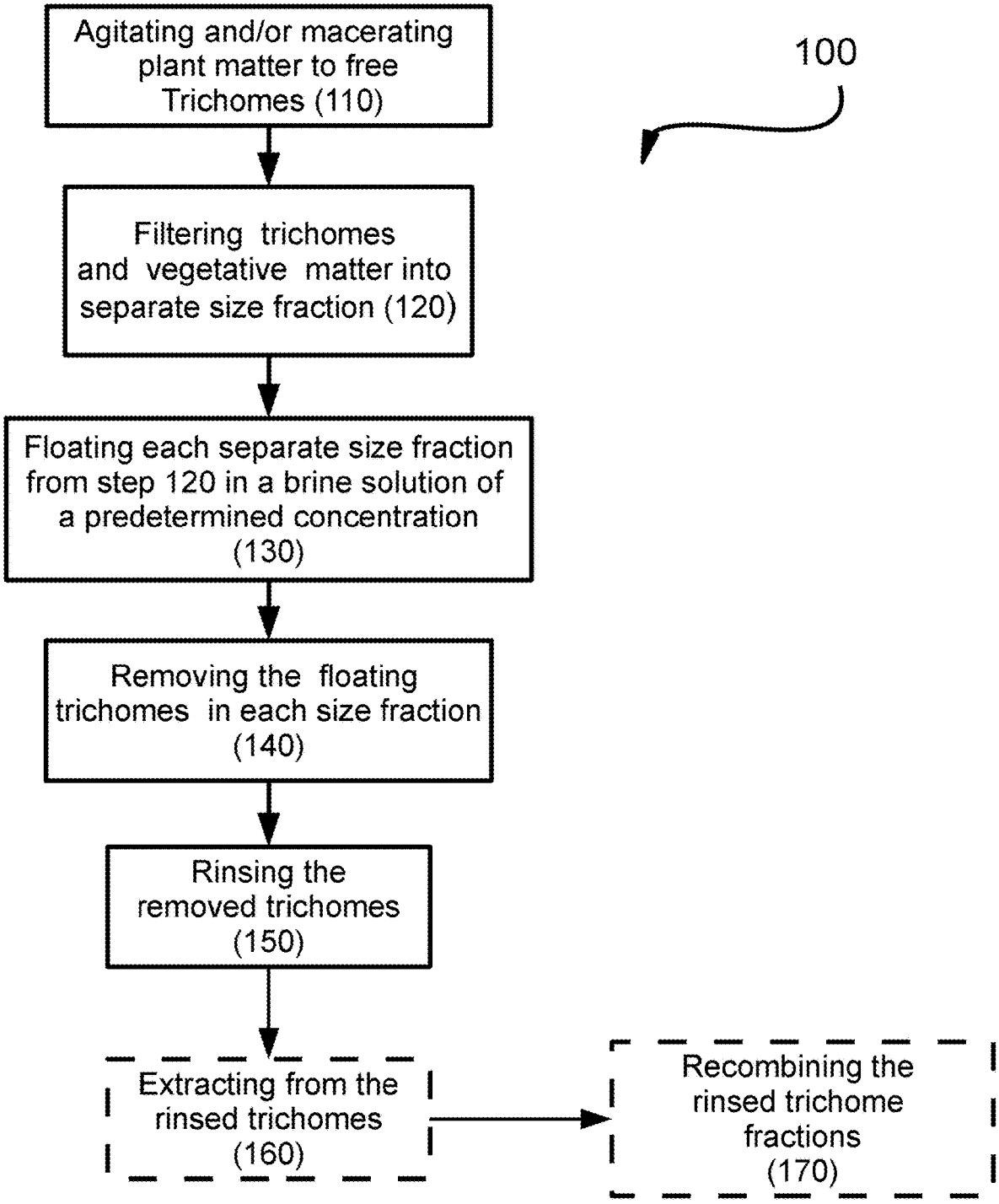
FIG. 3 is a schematic flow chart of a more preferred embodiment of the process.

This improved process is illustrated in FIG. 3 in which in step 130, each sieve fraction is separately floated. In step 170, the trichomes from each fraction are optionally recombined at the end. The optional solvent separation step, 160, can be performed before or after the recombination. To the extent plants can be bred to create different chemical species in different size trichomes, it may be desirable to perform the solvent extraction from each trichome size fraction separately. As the trichome fraction are largely free of vegetative matter, the undesired components (lipids/waxes, pigments) of associated plant material will not be co-extracted.

It is important to use a brine that does not contain or introduce solid particle of any type, other than agents that can generally be washed or removed in subsequent processing, that is the brine should consist essentially of water and a salt or salt mixture, which can include other water soluble compounds and additive. Brine salts are the primary components responsible for the greater density than water, and as such constitute the essential character of this aspect of the invention.

After the desired fractions that float are removed from the sinking fractions, they are rinsed to remove brine. The rinse water is easily purified by reverse osmosis, which generates more brine for reuse in the process, after appropriate modifications of concentration to achieve the preferred density.

Figure 4:
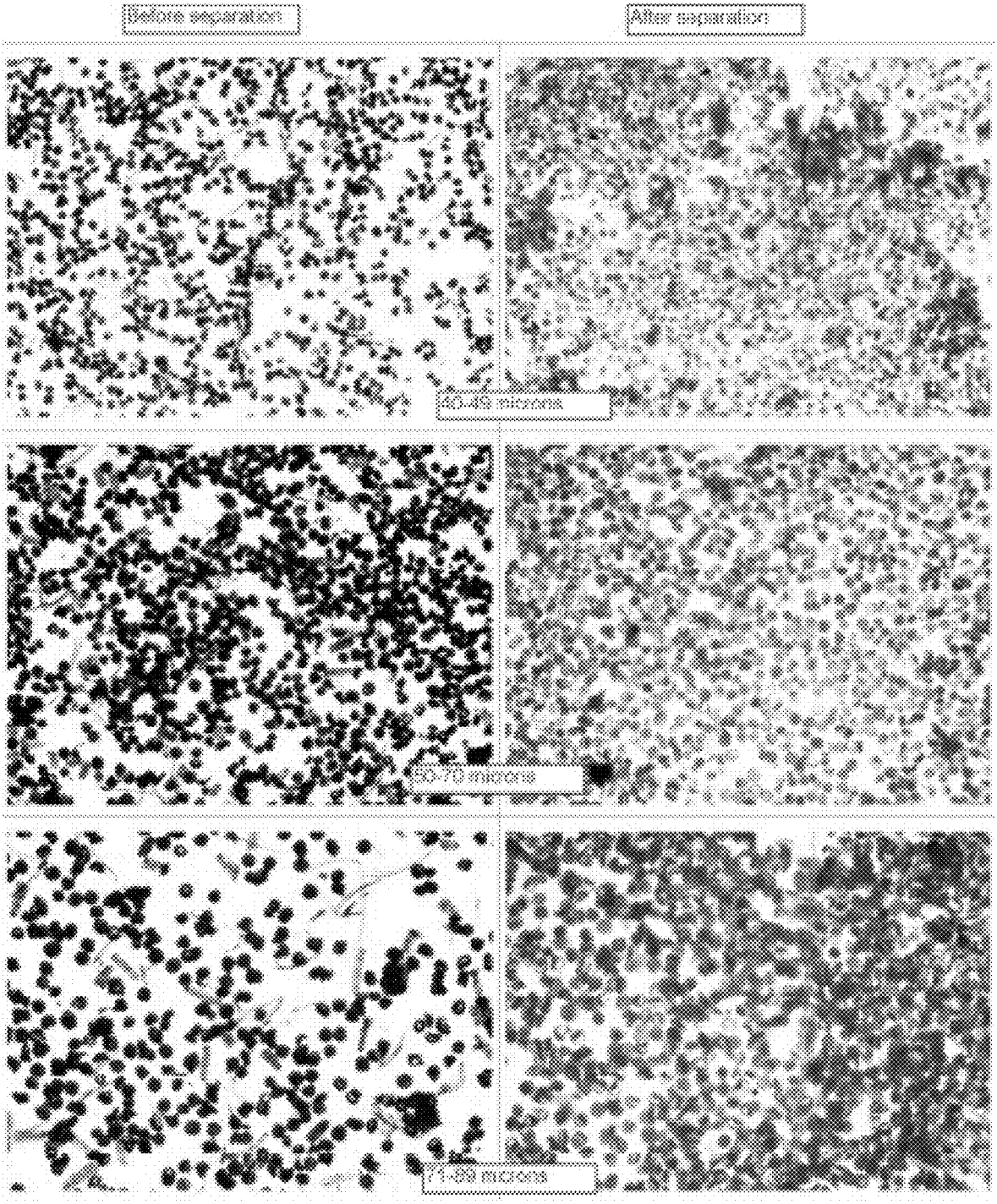
FIG. 4 compares in optical micrographs the three indicated size fraction after wet sieve separation and before and after separation in different brine solutions.
Figure 5:
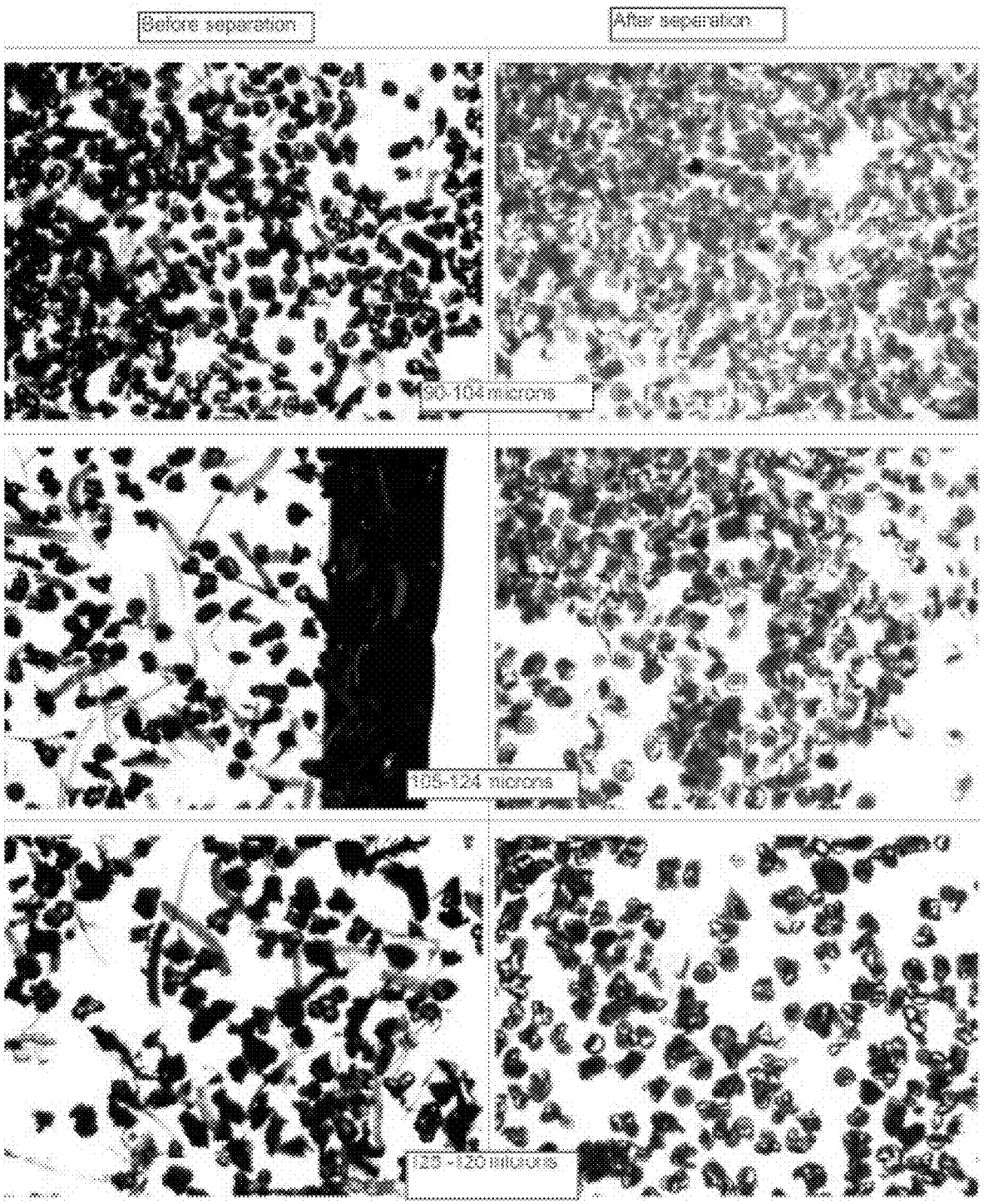
FIG. 5 compares in optical micrographs the three indicated size fraction after wet sieve separation and before and after separation in different brine solutions.

It has been discovered that as the preferred process results in a resin product that is more pure, as it has a lower ratio of stalks, cystolith hairs and other undesirable plant debris to trichome resin heads, as shown in the micrographs in FIGS. 4 and 5. While each sieve fraction in the left column in these Figures contains stalks, plant debris and globular resin heads, the right column show the floating matter that has been collected according to the conditions of Table 1 is full, bulbous clear trichome heads that are essentially free of stalks, cystolith hairs and other undesirable plant debris.

As the trichome fractions once separated as shown in FIGS. 4 and 5 in the right hand column are essentially resin heads free of stalks, cystolith hairs and other undesirable plant debris, the can be recombined to yield a final resin product of about 3.4 grams, with between about 70-75 weight percent total active cannabinoids, based on prior experimental results been measured by high performance liquid chromatography.

All of the above methods described generally and more specifically with respect to Cannabaceae trichomes, are also applicable to separating and/or purifying trichomes from the other plant species, with appropriate adjustment in the fluid 135 to account for the density variation of the trichomes and other objective of the separation process. The density of the trichomes will depend largely on the plants species, which have different biochemical processes during plant growth, and can also vary with the growth stage and maturity of the plant. For example, in the case of the trichomes from the hop plant they contain varying percentages of alpha acids or humulones, beta acids or lupulones, essential oils (such as the terpene hydrocarbons myrcene, humulene and caryophyllene, among many other), and flavonoids, primarily xanthohumol, as well as 8-prenylnaringenin and isoxanthohumol. As many of these compounds have long chains of olefin hydrocarbons, the density of the trichomes can be significantly lower than those of other plants species. Hence, it may be preferable to float or suspend such glandular trichomes, depending on the plant species, on the brine or fluid 135 having a higher density than the trichome, which in the case of hops trichomes, among others, is preferably greater than about 1.08 gm/cc, more preferably greater than about 1.05 gm/cc and most preferably greater than about 1.01 gm/cc.

Further, while it is preferable that the fluid be a brine salt, other fluids can be used if it is desirable to avoid extraction of water soluble trichome components in the aqueous brine, such as organic compounds, and more preferably continuous phase organic compounds without suspended matter. Moreover, as the essential objective is to separate the trichome from other plant matter, so long as the plant matter, and particularly any macerated plant matter, sinks in the fluid faster than the trichome, the sinking plant matter can be removed before the released trichomes have floated to the top of the fluid 135. This particularly is the case when the released trichomes float relatively slowly due to a small size, and the larger plant matter sinks faster.

Further, depending on the nature of the fluid 135, the residue after the trichomes are removed may be de-minimus or inconsequential with respect to the intended purpose of the resulting product, and further rinsing of fluid and/or drying may not be necessary or may essentially occur as a result of further purification of separation of chemical compounds in the trichomes, or reactions, such as forming chemical derivatives of compounds in the trichomes to create novel compounds as flavoring agents, medicines, insecticides, insect attractants, insect repellants and like.

Another aspect of the invention is a process of treating plant material in which an aqueous solution of an ionic salt promotes the release of trichomes from the disk cells they are attached to. The disk cells secrete the chemical compounds that form a bulbous resin rich trichome bead, which can also be referred to as a glandular trichome. In *Cannabis* sp. the disk cells are highly specialized cells that are the primary site of biosynthesis of cannabinoids and terpenes concentrated in the glandular trichomes. However, the general principles disclosed herein are applicable to other species of plant trichomes, particularly for extracting hops trichomes from the cones, flowers and buds of hops plants.

The ionic salts disclosed as useful for floating the trichomes to separate them from the plant material will also cause disk cells to swell and become oedemic. Disk cells exposed to an aqueous solution containing an ionic salt in a strength greater than would naturally be in the cytosol of the cell become oedemic and, as a group, frequently expand several times their size. In this process, some disk cell assemblies separate from the desirable part of the trichome completely. The aqueous solution containing the ionic salt can be considered as osmoticum. It has been observed that due to the strongly hydrophobic nature of the desirable portion of a glandular trichome that no water gain or loss is observed when in contact with aqueous osmoticum such as brine. However, disk cells are hydrophilic due in part to their biologically active nature.

Since the disk cells are in direct contact with host plant tissue, failure to either detach or release the glandular trichomes can result in some portion of the desirable glandular trichome being left behind on vegetative or plant material and matter, such as plant tissues. Hence, it is desirable to add an osmoticum prior to physical agitation and/or maceration to enhance the liberation of otherwise unattainable trichomes from a portion of the disk cells that themselves would fail to release from the plant matter or tissue within the plant materials, such that the glandular trichomes that release from these disk cells will be collected in the process. In order to fully remove disk cells assemblies and individual disk cell parts from the desirable parts of glandular trichomes, brine-treated vegetative matter or plant material containing trichomes can be suspended in an aqueous solution and agitated via mechanical forces, such as with a high speed blender or other form of rotating immersed blades, and any other means that cause high shear forces in the supporting brine, as well as aggressive shaking, stirring, re-circulating water jets, and agitation with ultrasound. The agitation step may optionally macerate the plant material and plant tissue to form smaller fragment of plant tissue.

Depending on the nature of the plant material, different ionic salts or salt mixtures may be deployed at concentrations higher than necessary to float the disk cells that do release, which may cause the undesirable plant matter or material, such as macerated plant tissue to float as well. The degree of oedema exhibited by the disk cells can be greatly enhanced by using brine strengths greater than those disclosed as sufficient to float the glandular trichomes but still have the undesirable plant matter or tissue sink. It has been discovered that brine salts with a concentration of about 1.2-1.3 gm/ml accelerate the release of intact glandular trichomes from disk cells, and reduce the energy and time of maceration that is required when the ideal brine concentration for floating glandular trichomes in a brine, in which the plant matter and disk cell fragments will sink. Such brines that act as an osmiticum for disk cells also preferably have a mixture of salts that is preferably a magnesium salt and a chloride salt, more preferably being a mixture of magnesium sulfate ($MgSO_4$) and sodium chloride (NaCl) and most preferably a composition of about 90/10% $MgSO_4$/NaCl.

Figure 6:
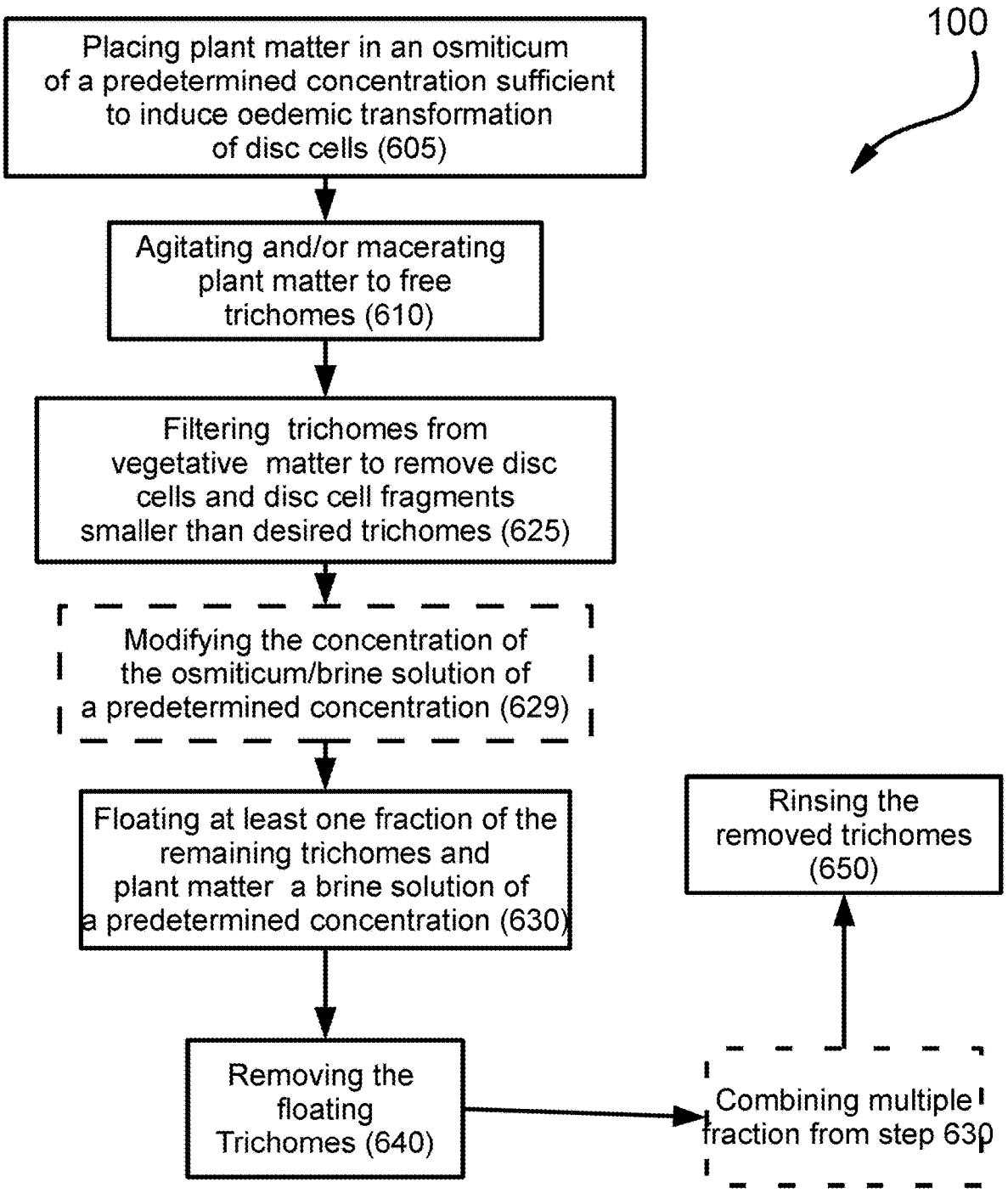
FIG. 6 is a schematic flow chart of an alternative embodiment of the process.

In another embodiment of the invention illustrated as a process in FIG. 6 plant material such as flower and buds or other plant or vegetative material or matter containing trichome can be placed in a osmoticum of a predetermined concentration sufficient to induce oedemic transformation of the disk cells (step 605) as an initial step.

In step 610, agitating and/or macerating the plant matter or material in the osmiticum of step 605 may free trichomes that remain attached to disk cells, as well as free disk cells that may or may not have attached trichomes from the other plant tissue, including other disk cells in disk cell assemblies. Disk cells tends to form clustered assemblies that can be 20-30 microns in diameter, with individual disk cells being about 5 to 10 microns in diameter. The individual disk cells may be triangular or wedge like segments, so that the wedges in a clustered assembly have a generally circular shape. The disk cell assemblies may separate completely from the trichomes or plant matter or tissue, but can also remain attached as the group or assembly of disk cells. In both instances, these now liberated cells or cell groups may now be removed by washing the trichome and vegetative or plant matter/tissue mixture on a sieve to remove the now smaller sized fractions of undesirable disk cells or disk cell assemblies in step 625. It is important to note that individual disk cells break apart from the assemblies and are significantly smaller than the intact desired portions of the trichomes, and therefore easier to remove by rinsing. Hence, in step 625, the free trichomes and vegetative or plant matter are filtered to remove disk cells and disk cell fragments smaller than the desired trichome size. Separate size fractions of mixed trichomes and vegetative or plant matter/tissue may be isolated after this step, and each such fraction separately treated in step 629, 630, 640 before optionally being optionally recombined in step 645.

In step 629, the brine is optionally diluted to reduce the concentration to provide a desired pre-determined density of the diluted brine that allows the trichomes to float and the plant matter/tissue to sink.

Then in step 630, the filtered material or fraction from step 625 is placed in the optionally diluted brine to float the desired trichomes.

Then after the trichomes float and the plant matter/tissue substantially sink in the diluted brine, the floating trichomes are removed in step 640.

If separate fractions from step 625 were isolated for each of steps 629 and 630, they may be recombined in optional step 645, before or after rinsing to the remove the brine in step 650.

Figure 7:
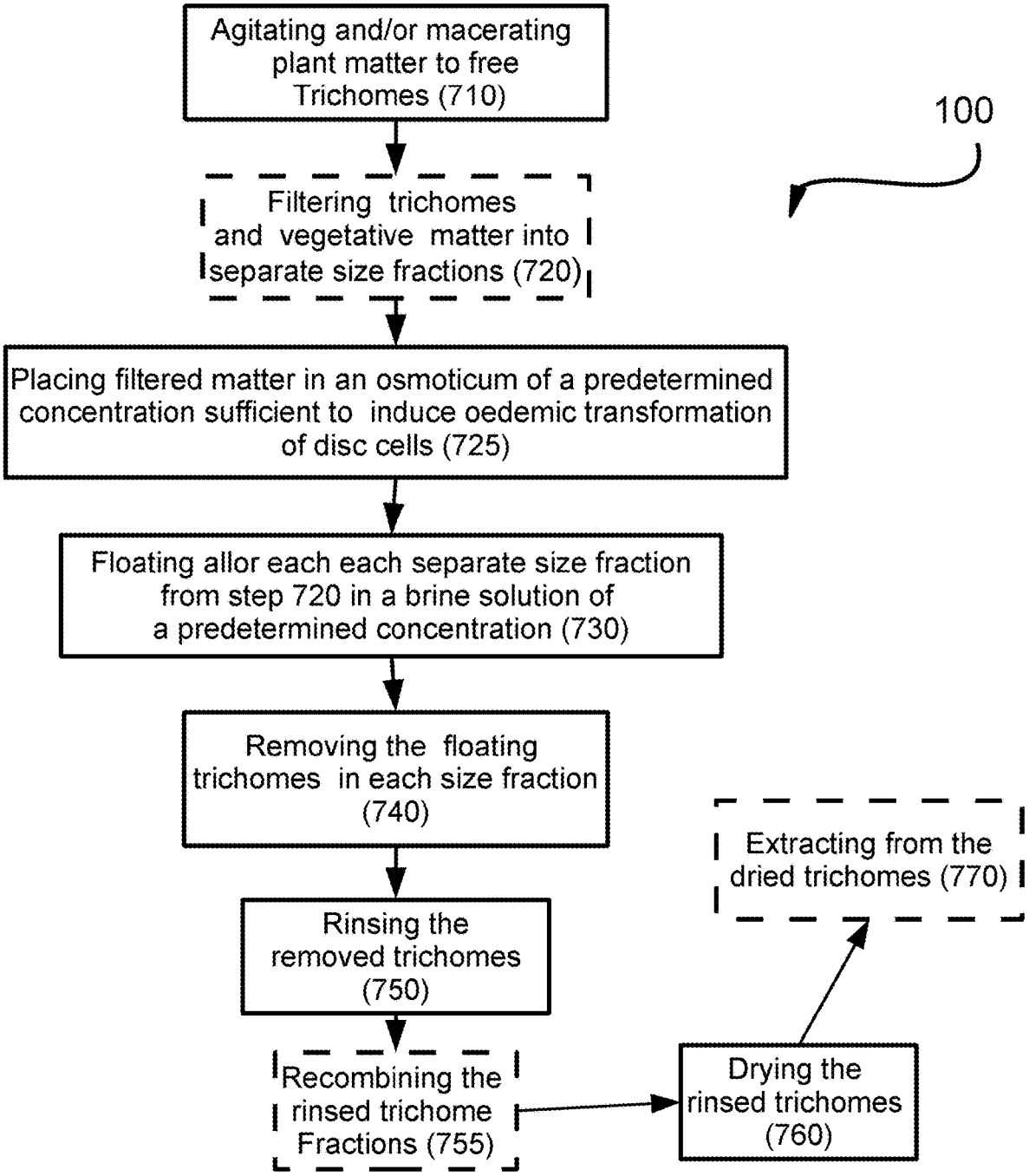
FIG. 7 is a schematic flow chart of another alternative embodiment of the process.

In another embodiment of the invention illustrated as a process in FIG. 7 plant material such as flower and buds or other plant or vegetative matter containing trichomes can be agitated or macerated to free trichomes in step 710, such as in water or in a brine before being placed in the osmoticum in step 725.

Then in step 720, the free trichomes and vegetative or plant matter/tissue are optionally filtered, such as with sieves or screens, to remove large plant matter and/or smaller trichomes. Separate size fractions of mixed trichomes and vegetative or plant matter/tissue may be isolated after this step 720 and each such fraction separately treated in step 725, 730, 740 before optionally being recombined before or after rinsing in step 750.

Then in step 725, as the filtered material from step 720 that may still contain trichomes bounds to disk cells, as well as other vegetative matter is placed in an osmoticum of a predetermined concentration sufficient to induce oedemic transformation of the disk cells to induce glandular trichome separation.

Before step 730 of floating the mixed trichomes, disk cells, disk cell fragments and other vegetative matter from step 725, the brine concentration is optionally reduced from step 725 to a second predetermined level so the trichomes float and other plant matter/tissue sinks.

In step 730, the brine may be reduced to a different concentration that is optimum for each size fraction of trichomes. For example, it has been discovered in many *Cannabis* sp. that the trichomes separated by filtration to a size range of 91 to 184 microns are best separated from plant matter/tissue of the same size in a brine with a specific gravity (gm/cc) of less than or equal to about 1.12. However, smaller trichomes in the size range of 90 to 71 microns are more efficiently separated in a higher specific gravity brine, such as greater than about 1.13, but more preferably at about 1.14 to about 1.15 or greater. Similarly, even smaller trichome fractions ranging in size from 70-41 microns are best separated from plant matter/tissue of the same size in a brine with an even higher specific gravity, being equal to about 1.15 to 1.16, or greater.

Then in step 740, the floating trichomes are removed. There after the trichomes are rinsed to remove brine in step 750, they are then dried in step 760. The drying in step 760 may be before or after any separate fractions of trichomes are recombined, such as in step 755. In step 770, the dried trichomes are optionally treated to extract select components, such as by fractional distillation, or mixed in solvent or carrier for other purposes, as well as applying heat and high pressure to the trichomes in a mesh bag to melt and heat express the desirable portions leaving vegetative matter in the mesh bag.

Figure 8:
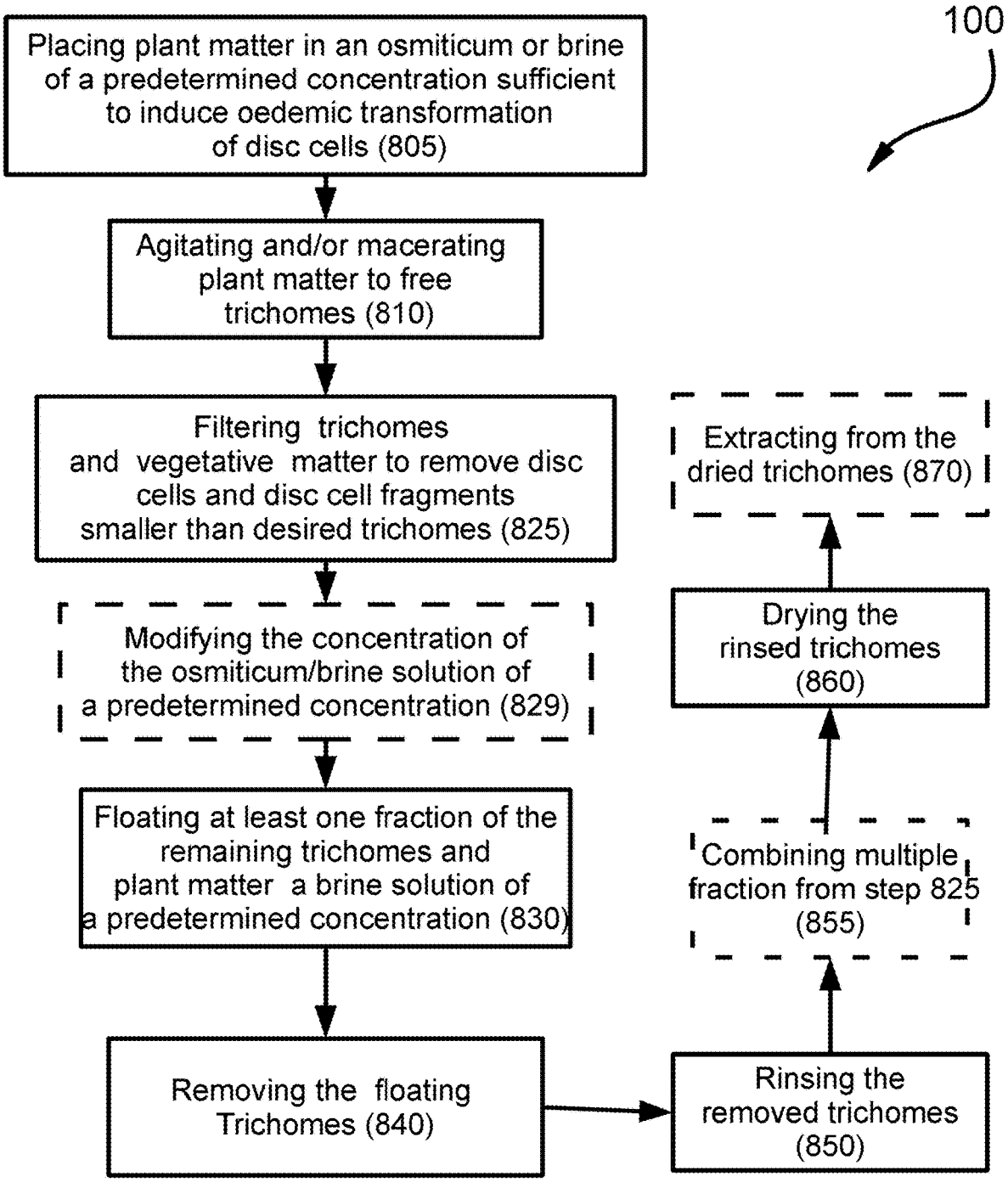
FIG. 8 is a schematic flow chart of another alternative embodiment of the process.

In another embodiment of the invention illustrated as a process in FIG. 8 plant matter such as flower and buds or other plant matter containing trichome can be placed in the osmoticum in step 805.

In step 810, agitating and/or macerating the plant matter may frees trichomes that remain attached to disk cells, as well as frees disk cells that may or may not have attached trichomes from the other plant matter.

In step 825, the free trichomes and vegetative or plant matter are filtered to remove disk cells and disk cell fragments smaller than the desired trichome size. Separate size fractions of mixed trichomes and vegetative or plant matter may be isolated after this step, and each such fraction separately treated in step 829, 830, 840 before optionally being optionally recombined in step 855, either before or after the step of rinsing in step 850.

In step 829, the brine is optionally diluted to reduce the concentration to provide a desired pre-determined density of the diluted brine that allows the trichomes to float and the plant matter, including disk cell fragments, to sink.

Then in step 830, the filtered material or fraction from step 825 is placed in the optionally diluted brine. Then after the trichomes float and the plant matter substantially sink in step 830, the floating trichomes are removed in step 840.

The trichomes are rinsed in step 850 and then dried of the rinsing fluid, usually water, in step 860. Thereafter in step 870, the dried trichomes are optionally treated to extract select components, such as by fractional distillation, or mixed in solvent or carrier for other purposes.

It should be appreciated that in any of steps agitating or maceration after the placement of the plant matter in the osmiticum, in steps 610 or 810 mechanical shearing forces help to completely dislodge any remaining stuck oedemic disk cell assemblies or disk cells from the desirable portion of the glandular trichome. In steps 625 and 825 the vegetative trichome mix is preferably placed back on a sieve of appropriate size to retain the trichomes and are then rinsed to remove the undesirable disk cell components. This step is important in that it enhances the total yield of the desirable floating portion. The separate screen portion retained after this rinsing step may be recombined for floating in brine in steps 630 and 830. If the disk cells they remain attached to the desirable parts of the glandular trichomes, since they are not buoyant, the smaller glandular trichomes are dragged down to the lower layer of the separation with the disk cell fragments and are either eventually discarded or require additional filtering or extraction steps to recover.

In such a case, any portion of the undesirable plant matter that cannot be removed at a previous stage by physical separation based on size, can still be removed by diluting the osmoticum to a concentration that provides the desirable density at which the glandular trichomes float and the plant undesirable plant matter sinks.

Figure 9:
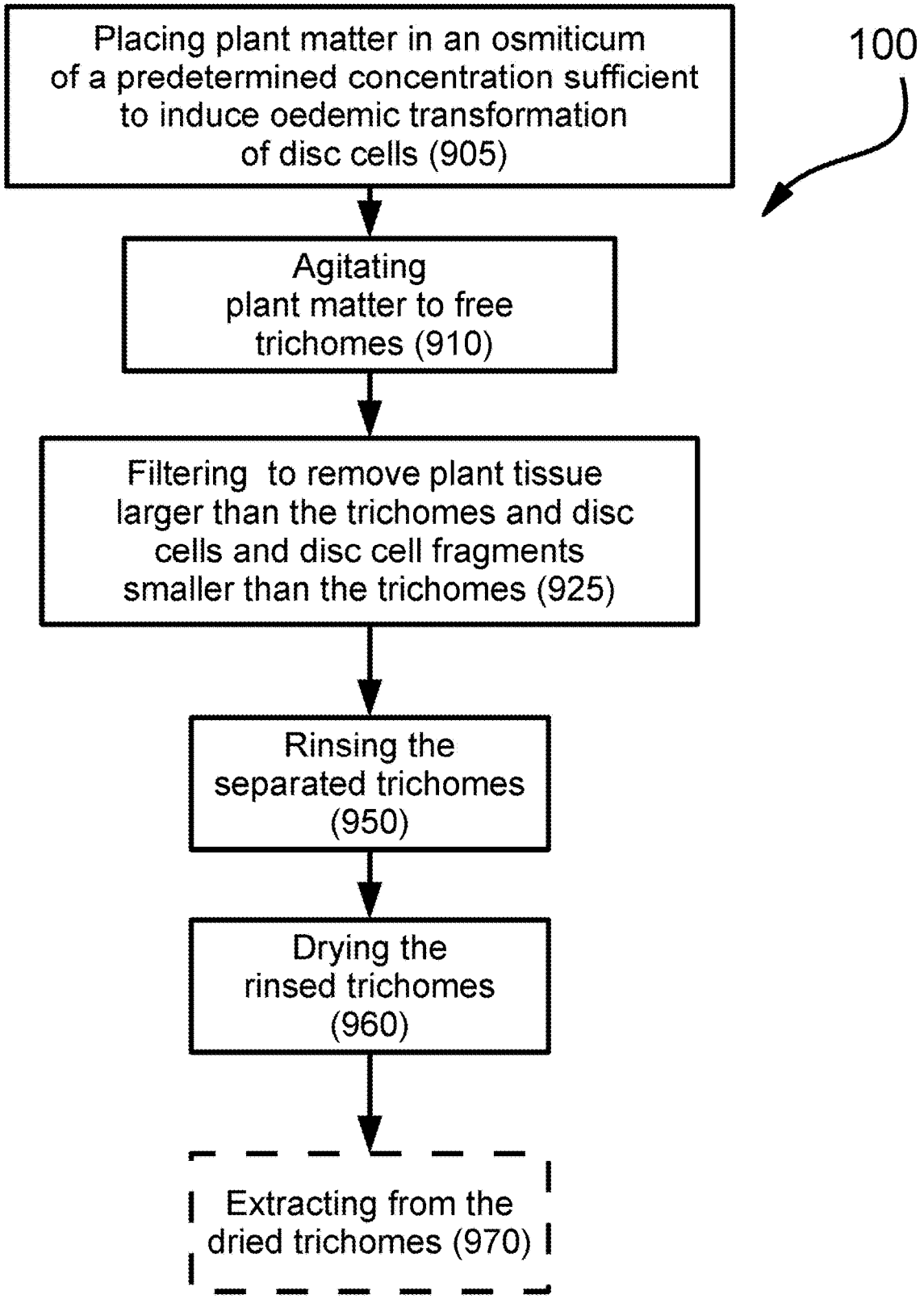
FIG. 9 is a schematic flow chart of another alternative embodiment of the process.

In another embodiment of the invention illustrated as a process in FIG. 9, plant material such as flower and buds or other plant or vegetative material or matter containing trichome is placed in a osmoticum of a predetermined concentration sufficient to induce oedemic transformation of the disk cells (step 905) as an initial step.

In step 910, agitating and/or macerating the plant matter or material in the osmiticum of step 905 may free trichomes that remain attached to disk cells, as well as free disk cells that may or may not have attached trichomes from the other plant tissue, including other disk cells in disk cell assemblies.

The agitated and/or macerated the plant matter or material from step 910 may be filtered to remove disk cells and disk cell fragments smaller than the desired trichome size, that is generally smaller than about 40 microns, as well as to remove plant matter or tissue that is smaller than the desired trichome size of about 180 microns. This can be accomplished by confining or pass the agitated and/or macerated the plant matter or material from step 910 between a screen or mesh with 180 micron openings on one side and the 40 micron opening on to other side. If the agitation and/or maceration process is carried out under conditions of shear that avoid fragmenting the plant tissue into fragments smaller than 180 microns, the trichome fractions retained between the screens can be largely free of plant matter, as well as disk cells and disk cell fragments. It should now be appreciated that exposure to a strong brine as the first step, lowers the level of agitation force necessary to release trichomes, and hence, can avoid also forming the plant fragments smaller than 180 microns that would need to be separated by flotation in the other embodiments.

The trichomes are rinsed in step 950 and then dried of the rinsing fluid, usually water, in step 960. Thereafter in step 970, the dried trichomes are optionally treated to extract select components, such as by fractional distillation, or mixed in solvent or carrier for other purposes, as well as applying heat and high pressure to the trichomes in a mesh bag to melt and heat express the desirable portions leaving non meltable solid material behind, or simply using heat and pressure to compact the trichomes particles in to a solid mass.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A method of trichome separation from plants, the method comprising the steps of:

a) providing a trichome bearing plant material, in which the trichomes comprise trichome beads attached to one of disk cells and disk cell assemblies, b) introducing the trichome bearing plant material in a brine of sufficient concentration to swell the disk cells to release at least some of the trichomes beads from the disk cells, c) removing at least the trichome beads that are released from the disk cells from the brine.

2. The method of trichome separation from plants according to claim 1 wherein said step of removing trichome beads that are released from the disk cells from the brine further comprises removing a portion of the brine that contains the trichome beads and at least one of disk cell assemblies, disk cells and stalks, passing the removed portion through a screen having openings of a predetermined size to retain the trichome beads on the screen and remove smaller disk cell assemblies, disk cells and stalks through the openings in the screen.

3. The method of trichome separation from plants according to claim 2 wherein said step of removing trichomes from the brine further comprises a step of placing the trichomes and any residual plant matter retained on the screen in a fluid in which the trichome beads float and other plant matter sinks and then removing the floating trichome beads from the fluid.

4. The method of trichome separation from plants according to claim 3 wherein the fluid has a lower specific gravity than the brine.

5. The method of trichome separation from plants according to claim 3 wherein the fluid is obtained by diluting the brine.

6. The method of trichome separation from plants according to claim 1 wherein the brine comprises one or more salts selected from the group consisting of sodium chloride, magnesium chloride and magnesium sulphate.

7. The method of trichome separation from plants according to claim 1 further comprising a step of at least one of agitating and macerating the trichome bearing plant material to induce the separation of at least one of trichomes, trichome beads, disk cell assemblies, disk cells and stalks from the trichome bearing plant matter.

8. The method of trichome separation from plants according to claim 1 wherein the brine has a first specific gravity and the step of removing at least trichome beads that are released from the disk cells from the brine further comprises;

i. separating one or more predetermined size fractions of the matter from the brine, ii. rinsing the one or more predetermined size fractions on a screen to retain the trichome beads and remove disk cells and fragments of trichomes than are smaller than the openings in the screen, iii. floating the rinsed one or more predetermined size fractions on a fluid having a second specific gravity, iv. removing the trichome beads that float on the fluid having a second specific gravity after other matter sinks in the fluid, v. rinsing the removed trichome beads.

9. The method of trichome separation from plants according to claim 1 further comprising the steps of;

i. diluting the brine to reduce the density such that at least some of the trichome beads released from the disk cells float and other matter sinks, ii. removing the floating trichome beads, iii. rinsing the removed trichome beads to remove a residue of the brine, and iv. drying the rinsed trichome beads.

10. The method of trichome separation from plants according to claim 9 wherein the brine comprises one or more salts selected from the group consisting of sodium chloride, magnesium chloride and magnesium sulphate.

11. The method of trichome separation from plants according to claim 9 further comprising a step of filtering to remove disk cell fragments smaller than the trichomes before said step of diluting the brine.

12. The method of trichome separation from plants according to claim 7 wherein said step of agitating is by one or more of shaking, stirring, stirring with at least one of immersed blades and re-circulating water jets, and agitation with ultrasound.

13. The method of trichome separation from plants according to claim 1 wherein the plant is a from a genera selected from the group consisting of *Populus, Nicotiana, Cannabis, Pharbitis, Apteria, Psychotria, Mercurialis, Chrysanthemum, Polypodium, Pelargonium, Mimulus, Matricaria, Monarda, Solanum, Achillea, Valeriana, Ocimum, Medicago, Aesculus, Plumbago, Pityrogramma, Phacelia, Avicennia, Tamarix, Frankenia, Limonium, Foeniculum, Thymus, Salvia, Kadsura, Beyeria, Humulus, Mentha, Artemisia, Nepta, Geraea, Geraniaceae, Pogostemon, Majorana, Cleome, Cnicus, Parthenium, Ricinocarpos, Hymennaea, Larrea, Primula, Phacelia, Dryopteris, Plectranthus, Cypripedium, Petunia, Datura, Mucuna, Ricinus, Hypericum, Myoporum, Acacia, Diplopeltis, Dodonaea, Halgania, Cyanostegia, Prostanthera, Anthocercis, Olearia, Viscaria.*

14. The method of trichome separation from plants according to claim 1 wherein the plant is from a genera selected from the group consisting Cannabaceae and Lamiaceae family.

15. The method of trichome separation from plants according to claim 9 further comprising a step of extracting the dried trichomes.

16. The method of trichome separation from plants according to claim 8 further comprising a step of combining two or more predetermined size fractions of matter before said step of rinsing.

17. The method of trichome separation from plants according to claim 1 wherein the brine comprises one or more salts selected from the group consisting of sodium chloride, magnesium chloride and magnesium sulphate.

18. The method of trichome separation from plants according to claim 8 wherein the brine has a specific gravity of at least 1.2 gm/cc and the fluid having substantially the same composition as the brine has a second specific gravity of less than 1.19 gm/cc.

19. The method of trichome separation from plants according to claim 8 wherein said step of floating the rinsed one or more predetermined size fractions of trichomes and plant matter in a fluid of second specific gravity comprises floating at least one different size fractions in a second fluids having a different specific gravity than for at least another different size fraction.

* * * * *